United States Patent [19]

Lechner

[11] Patent Number: 4,592,467

[45] Date of Patent: Jun. 3, 1986

[54] DEVICE INSTALLED IN PASSENGER CARS FOR SMASHING WINDOWS AFTER TRAFFIC ACCIDENTS

[76] Inventor: Helmut Lechner, Forellenweg 1, 359o Bad Wildungen-Wega, Fed. Rep. of Germany

[21] Appl. No.: 637,213

[22] PCT Filed: Nov. 10, 1983

[86] PCT No.: PCT/DE83/00185

§ 371 Date: Jul. 13, 1984

§ 102(e) Date: Jul. 13, 1984

[87] PCT Pub. No.: WO84/01917

PCT Pub. Date: May 24, 1984

[30] Foreign Application Priority Data

Nov. 18, 1982 [DE] Fed. Rep. of Germany ... 8232386[U]

[51] Int. Cl.[4] ..... B25F 1/00; B25D 1/00; B25B 27/00

[52] U.S. Cl. ..... 206/349; 206/352; 206/477; 7/144; 7/145; 211/70.8

[58] Field of Search ..... 206/349, 352, 477, 482; 211/70.6, 70.8, 64, 66, 60.1; 7/144, 145, 146, 147

[56] References Cited

U.S. PATENT DOCUMENTS

| | | | |
|---|---|---|---|
| 743,622 | 11/1903 | Daniels | 7/146 |
| 1,176,192 | 3/1916 | Beckton et al. | 7/145 |
| 1,924,015 | 8/1933 | Balth | 7/144 |
| 2,005,176 | 6/1935 | Arbuckle | 7/145 |
| 2,105,239 | 1/1938 | Bachtold | 7/145 |
| 2,919,058 | 12/1959 | Thompson | 211/64 |
| 3,623,173 | 11/1971 | Hagqvist | 7/145 |
| 3,735,860 | 5/1973 | Nissen et al. | 206/349 |
| 4,069,915 | 1/1978 | Schurman | 206/349 |
| 4,373,628 | 2/1983 | Dantes | 206/349 |

FOREIGN PATENT DOCUMENTS

| | | | |
|---|---|---|---|
| 8203739 | 7/1982 | Fed. Rep. of Germany . | |
| 2719 | of 1914 | United Kingdom | 7/144 |

*Primary Examiner*—William Price
*Assistant Examiner*—Brenda J. Ehrhardt
*Attorney, Agent, or Firm*—Max Fogiel

[57] ABSTRACT

A device for smashing or breaking windows in the event of a traffic-accident. The device has a holding plate with holes for the attachment thereof, and clips for the accommodation of a hammer. The holding plate consists of a base of T-shaped configuration while the hammer is provided, in the vicinity of the head thereof, with two symmetrical tips and, in the vicinity of the free end of the handle, with a blade for cutting safety belts. In the three end-regions of the T-shaped configuration of the base, there are protective walls which cover the hammer-tips and the free end of the hammer-handle.

2 Claims, 4 Drawing Figures

DEVICE INSTALLED IN PASSENGER CARS FOR SMASHING WINDOWS AFTER TRAFFIC ACCIDENTS

The invention relates to a device, more particularly to be secured in passenger-cars, for smashing the windows in the event of a traffic accident, the device comprising a holding plate with holes for the attachment thereof and clips for the accommodation of a hammer. In the event of an accident in which the doors of the vehicles can no longer be opened, such devices allow the persons thus locked in to smash the windows and thus to escape from the vehicle.

Devices of the type mentioned at the beginning hereof are known in omnibuses and railroad-cars, where they are used only for smashing windows after accidents. The holding plate comprises openings for its attachment to the wall and holes through which attachment screws can be passed. The holding plate is also provided with clips into which a hammer and the handle thereof may be clamped, and thus held. The hammer consists of a wooden handle and a head made of metal. The head is differently formed at both end regions in the known manner. Devices of this kind have not hitherto been common in passenger-cars, even though, in the event of an accident, the doors may jam. In this case, the only way out for the passengers is through a smashed window.

It is an object of the present invention to provide a device of the kind described which will permit simple and rapid exit of the occupants of the vehicle when the doors become jammed and can no longer be opened. In this connection, as a result of the small amount of space available within a passenger-car, it is essential, on the one hand, for the device to be stored in a protected area, and, on the other hand, for it to be readily graspable and thus be available for use within the car in the event of an accident of the type indicated.

According to the invention, and in the case of a device of the type described, this is accomplished in that the holding plate consists of a base body with T-shaped contour, in that the hammer is provided, in the vicinity of its head, with two symmetrically arranged tips and comprises, in the vicinity of the free end of the hammer-handle, a blade for cutting safety belts, and in that protective walls covering the hammer-tips and the free end of the hammer-handle are provided in the three end-areas of the T-shaped contour. The T-shaped base corresponds to the outer contour of the hammer, so that the device as a whole, consisting of the holding plate and the hammer, has an attractive appearance. The device is also small enough to be arranged within reach of the occupants of a passenger-car, for instance on the carpeting under one of the front-seats or the like. Since the hammer-head has two symmetrically arranged tips in the region of the head, it is immaterial which of the tips is used to smash the windshield, a lateral window or the rear window of the car. Thus, it is not necessary to turn the hammer while smashing the windows. Passenger-cars are also known to be fitted with safety-belts, and in many kinds of accidents they can no longer be opened at the belt-lock and must therefore be cut. The free end of the hammer-handle is, therefore, fitted with a blade to be cut quickly and easily, so that the occupants can free themselves. On the other hand, the hammer and its two tips are accommodated in the base and are thus protected. Since the blade is also concealed, inadvertent injury to the occupants need not be feared.

The hammer tips may also be conical, in which case the protective walls on the base are V-shaped. This provides a fit between the holding plate and the hammer affording protection both to the hammer tips and to the occupants of the car. Moreover these protective walls hold the hammer additionally to the clips, in other locations, so that it cannot shift in the locking plate or become loose as a result of vibrations.

The two hammer-tips may be arranged in a continuous metal insert-element, whereas the hammer-handle consists of two half-shells adapted to be connected together. The two half-shells have expanded heads enclosing the insert-element. This provides an extremely effective instrument, in which weight is provided only in the head region by the metal insert-element. On the other hand, the handle, consisting of two aluminum die-castings, is correspondingly light in weight.

The insert-element may comprise peripheral grooves into which extend ribs of both half-shells of the handle, so that when the half-shells are connected together, the insert-element is held securely and fixed in place.

The hammer-handle may be fitted advantageously, near its free end, with an open notch passing through both half-shells, a blade being held, at the bottom of the notch, between the half-shells. In this connection, the configuration of the open notch is such that a finger cannot enter it, whereas a safety belt can enter easily and reach the knife at the bottom. If the notch is arranged at an angle to the axis of the hammer-handle, the safety-belt may be cut with a simple pull, and this can be done very rapidly.

A detachably mounted needle may be provided in the hammer-head and may be used to adjust or clean the windshield-washer nozzles in passenger cars. The device may thus be used for several purposes.

The invention is explained hereinafter in greater detail, in conjunction with the example of embodiment. There are shown:

Figure 1:
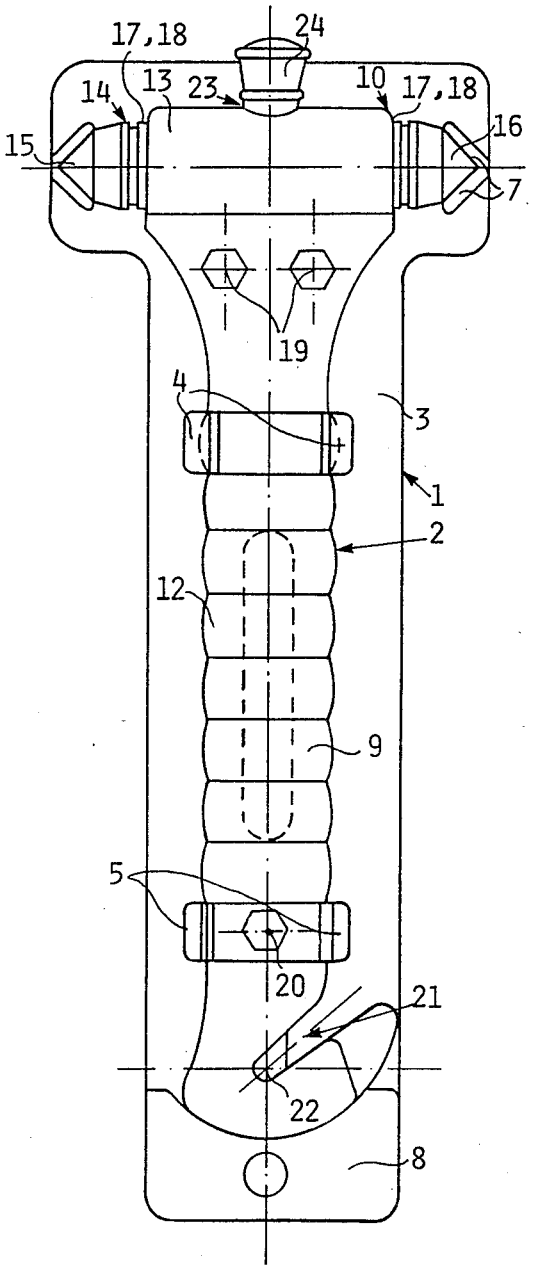
FIG. 1 is a view of the device consisting of a hammer and a holding plate.
Figure 2:
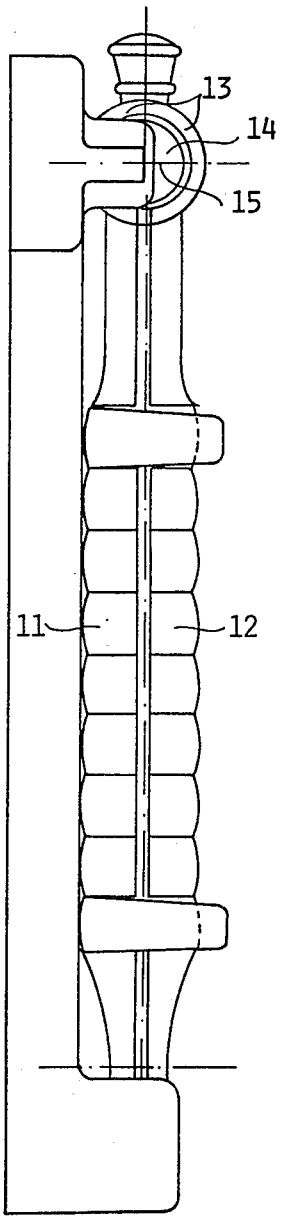
FIG. 2 is a side elevation of the device according to FIG. 1.

The device illustrated in FIG. 1 consists of two components adapted to each other, namely a holding plate 1 and a hammer 2. The holding plate consists of a base 3 having a T-shaped contour from which clips 4, 5 project. Located in the end-areas of the T-shaped base are two V-shaped protective walls 6 and 7 and one protective wall 8. These walls serve not only to protect the hammer, but also to hold and fix it in place more securely.

Hammer 2 comprises a handle 9 and a head 10, the central part of the handle 9 being ridged or grooved, or the like, in order to provide a non-slip hold of the hammer 2. The handle 9 is made of two half-shells 11, 12 which may be aluminum die-castings with expanded parts 13 in the head-region. These expanded parts accommodate an insert-element 14 which may be in the form of a continuous metal element and has two hammer-tips 15, 16. These tips are conically-shaped and terminate in points, and may thus be used to smash passenger-car windows easily and effortlessly.

V-shaped protective walls 6, 7 are adapted to the shape of hammer-tips 15, 16. They thus enclose the hammer tightly, thus holding hammer 2 to base 3 in addition to clips 4, 5. Insert-element 14 has peripheral grooves 17 in which ribs 18, formed from half-shells 11, 12, engage, thus securing the insert-element 14 immovably and securely in hammer-handle 9. Screws 19, 20 serve to connect half-shells 11, 12.

The free end of hammer-handle 9 comprises an open-edge notch 21 arranged at an oblique angle to its axis. The notch is narrower than the thickness of a human finger. Secured at the bottom of notch 21 is a blade 22 held between half-shells 11, 12. In the event of danger, the safety-belt may be inserted into open notch 21 and may be cut with blade 22.

Located in hammer-head 10 is a needle 23 with a knob 24. The needle extends into the interior of insert-element 14 which has an opening for this purpose. The needle is grasped by the knob and is withdrawn from the hammer. It may then be used to adjust and clean the windshield-washer nozzles or headlight-washer nozzles.

Figure 3:
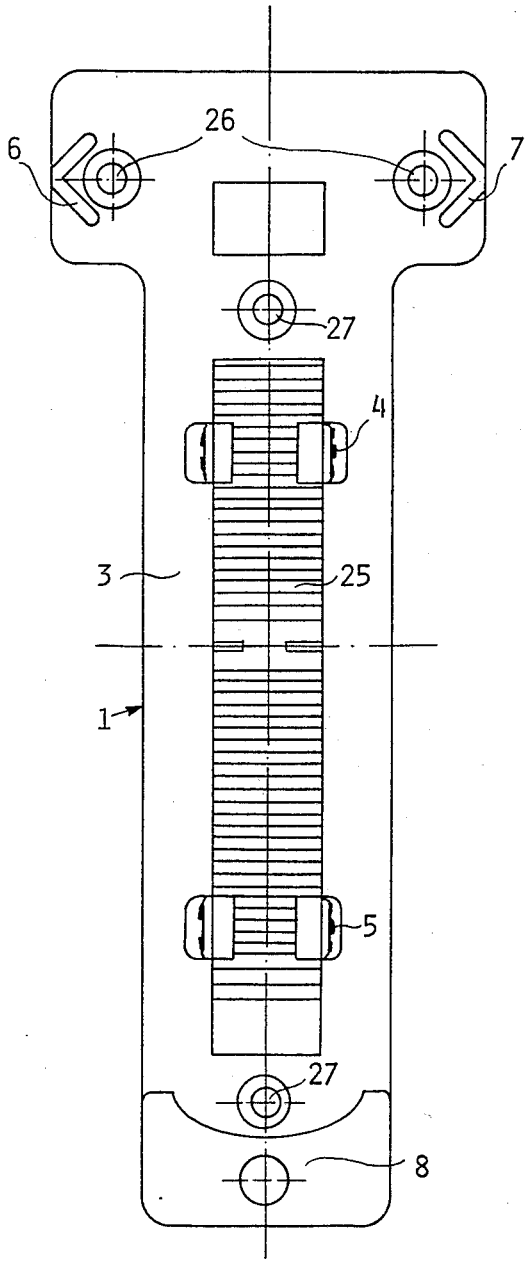
FIG. 3 is a view of the holding plate of the device.
Figure 4:
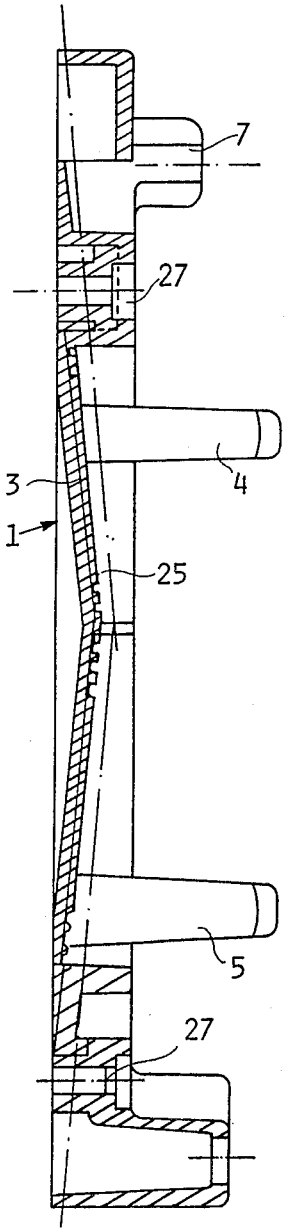
FIG. 4 is a side elevation of the holding plate according to FIG. 3.

FIGS. 3 and 4 show holding plate 1 with protective walls 6, 7, 8. In the central area, i.e. in the vicinity of clips 4 and 5, the base has a ramp-like rise 25 upon which the hammer 2 with handle 9 rests (the handle is not shown here). Base 3 also has openings 26, 27 for securing holding-plate 1 to the vehicle. This can occur with the aid of sheet metal screws which extend through the openings 26, 27. This can also be accomplished by means of long sliding needles, shown by dotted lines in FIG. 4. These can be inserted obliquely through other openings in holding-plate 1, for example into the carpeting, thus securing the holding plate so that it cannot slip. The sliding needles may be U-shaped. The sliding needles may engage lockingly, with the bent backs of the clips, in recesses of the ramp-like projection 25. Hammer 2 is held protected in the holding plate, so that there is no danger to the occupants of the car to be injured by hammer 2 or blade 22. On the other hand, when it is needed, the hammer may easily be removed from its mounting in the holding plate, so that in the event of danger after an accident, the safety-belts can very quickly be cut and the windows smashed. The hammer thus performs the function of a life-saver, being equipped to deal with the special problems which may arise in a passenger-car after an accident, namely cutting through the safety-belts on the one hand and smashing the windows on the other hand.

I claim:

1. A device in motor vehicles for smashing windows after traffic accidents, comprising: a holding plate with mounting means; a hammer for smashing the windows; clip means for attaching said hammer to said holding plate, said holding plate having a T-shaped base; said hammer having a head with two symmetrical tips; said hammer having a handle with a free end carrying a cutting blade for cutting safety belts; protective walls on said holding plate at end regions of the T-shape for covering said hammer tips and said free end of said hammer handle; a continuous metal insert element in said hammer head for holding said hammer tips; said hammer head having walls surrounding said insert element; said hammer handle comprising two half-shells connected to each other; said hammer handle having an open-edged notch passing through said half-shells in vicinity of said free end of said handle; said holding plate having two sliding needles for mounting said holding plate; said needles having a U-shape and extending while sliding in recesses of ramp-shaped projections on said holding plate.

2. A device in motor vehicles for smashing windows after traffic accidents, comprising: a holding plate with mounting means; a hammer for smashing the windows; clip means for attaching said hammer to said holding plate, said holding plate having a T-shaped base; said hammer having a head with two symmetrical tips; said hammer having a handle with a free end carrying a cutting blade for cutting safety belts; protective walls on said holding plate at end regions of the T-shape for covering said hammer tips and said free end of said hammer handle; a continuous metal insert element in said hammer head for holding said hammer tips; said hammer head having walls surrounding said insert element; said hammer handle comprising two half-shells connected to each other; said hammer handle having an open-edged notch passing through said half-shells in vicinity of said free end of said handle; said holding plate having two sliding needles for mounting said holding plate; said needles having a U-shape and extending while sliding in recesses of ramp-shaped projections on said holding plate; said hammer tips being conically-shaped; said protective walls being arranged upon said base in form of a V-shape; said insert elements having peripheral grooves, said two half-shells having ribs extending into said grooves.

* * * * *